US011793316B1

(12) United States Patent
Jennings et al.

(10) Patent No.: US 11,793,316 B1
(45) Date of Patent: Oct. 24, 2023

(54) SLEEPER SOFA WITH A SOLID SUPPORT DECK

(71) Applicant: Hickory Springs Manufacturing Company, Hickory, NC (US)

(72) Inventors: Joey Jennings, Hickory, NC (US); Dennis Cooke, Hickory, NC (US); Jason Porter, Hickory, NC (US)

(73) Assignee: HICKORY SPRINGS MANUFACTURING COMPANY, Hickory, NC (US)

( * ) Notice: Subject to any disclaimer, the term of this patent is extended or adjusted under 35 U.S.C. 154(b) by 603 days.

(21) Appl. No.: 16/295,367

(22) Filed: Mar. 7, 2019

Related U.S. Application Data

(60) Provisional application No. 62/640,102, filed on Mar. 8, 2018.

(51) Int. Cl.
*A47C 19/02* (2006.01)
*A47C 17/13* (2006.01)

(52) U.S. Cl.
CPC ..... *A47C 19/027* (2013.01); *A47C 17/13* (2013.01)

(58) Field of Classification Search
CPC ..... A47C 19/027; A47C 17/13; A47C 17/225; A47C 17/22; A47C 17/134; A47C 17/04
USPC ..... 5/13
See application file for complete search history.

(56) References Cited

U.S. PATENT DOCUMENTS 254,548 A * 3/1882 Herbet ..... A47C 17/40 5/507.1
1,052,706 A * 2/1913 Zingg ..... A47C 7/285 5/247
2,302,479 A * 11/1942 Tallmadge ..... A47C 23/02 267/103
2,485,443 A * 10/1949 Hathaway ..... A47C 23/16 5/255
2,545,310 A * 3/1951 Rosberger ..... A47C 27/061 5/935
2,861,278 A * 11/1958 Young ..... A47C 19/027 5/659
2,878,494 A * 3/1959 Healy ..... A47C 27/16 5/722
3,114,578 A * 12/1963 Hamilton ..... A47C 7/028 403/186
3,117,775 A * 1/1964 Hamilton et al. ..... A47C 7/285 267/110
3,716,875 A * 2/1973 Fehr ..... A47C 27/16 297/452.53
3,981,537 A * 9/1976 Wright ..... A47C 7/02 5/186.1
4,541,133 A * 9/1985 Reiss et al. ..... A47C 17/23 297/452.49

(Continued)

FOREIGN PATENT DOCUMENTS

JP 2007243115 A 9/2007
JP 2012019105 A 1/2012

(Continued)

OTHER PUBLICATIONS

Christian Becksvoort, "TabletopFlats", Mar.-Apr., 2006, pages 34-35 (Year: 2006).*

*Primary Examiner* — David R Hare
*Assistant Examiner* — Luke Hall
(74) *Attorney, Agent, or Firm* — BURR & FORMAN LLP

(57) ABSTRACT

A bed frame having a solid deck for a convertible sofa is provided. The bed frame comprises a pair of side rails and a bottom rail. The bed frame comprises at least a torso frame and a foot frame where the foot frame folds and unfolds with the torso frame to place the convertible sofa in the sofa configuration (folds) or the sleeping configuration (unfolds). The bed frame has at least one solid deck coupled to the torso frame of the bed frame.

14 Claims, 12 Drawing Sheets

(56) References Cited

U.S. PATENT DOCUMENTS

| | | | | |
|---|---|---|---|---|
| 4,704,751 | A * | 11/1987 | Guerra | A47C 23/062 5/236.1 |
| 5,188,343 | A * | 2/1993 | Galea | A47C 7/025 5/255 |
| 5,282,285 | A * | 2/1994 | de Gelis et al. | A47C 23/30 5/237 |
| 5,903,939 | A * | 5/1999 | Arft | A47C 17/225 5/13 |
| 6,219,863 | B1* | 4/2001 | Loberg et al. | A47C 23/064 5/613 |
| 6,701,551 | B1* | 3/2004 | Antinori | A47C 27/16 5/236.1 |
| 6,871,369 | B1* | 3/2005 | Long | A47C 27/148 5/659 |
| 7,353,553 | B2* | 4/2008 | Huse | A47C 27/16 297/452.53 |
| 9,839,295 | B2* | 12/2017 | Robinson et al. | A47C 3/00 |
| 2011/0089507 | A1 | 4/2011 | Mao | |
| 2011/0140217 | A1 | 6/2011 | Nguyen et al. | |
| 2011/0214231 | A1* | 9/2011 | Cabrera et al. | A47C 17/132 5/13 |
| 2013/0052826 | A1 | 2/2013 | Nepomnishy et al. | |

FOREIGN PATENT DOCUMENTS

| | | | |
|---|---|---|---|
| KR | 20080030384 | A | 4/2008 |
| WO | 2011024455 | A1 | 3/2011 |

* cited by examiner

SLEEPER SOFA WITH A SOLID SUPPORT DECK

CROSS-REFERENCE TO RELATED PATENT APPLICATIONS

The present application claims priority to U.S. Provisional Pat. Application Serial No. 62/640,102, filed Mar. 8, 2018, the disclosure of which is incorporated herein by reference as if set out in full.

BACKGROUND

Foldable furniture is used in a variety of applications including tables, recliners, portable apparatuses, and convertible sofas (which are sometimes referred to as sleeper sofas). Generally, foldable furniture has multiple positions. In one of the positions, the foldable furniture is unfolded.

With reference to convertible sofas, for ease of reference, the convertible sofa has a bed frame shown in FIG. 1 that folds into and out of the sofa. The bed frame 1 is unfolded to form a sleeping surface 2 as shown in FIG. 1. Generally, the sleeping surface 2 includes three frame parts, which will be referred to as the leg frame section 3, the torso frame section 4, and the head frame section 5. The head frame section 5 is conventionally considered the portion of the bed frame between the arm rests of the sofa. The bed frame 1 generally includes a top rail 6, a pair of side rails 7, 8 and a foot rail 9. One or more transverse members extending between the side rails 7, 8 may be provided as well. The bed frame 1 also comprises a mechanism 10 to allow for the bed frame 1 to fold into and out of the sofa unit. The mechanism 10 is generally known in the art and will not be further described herein except as required for context. The bed frame 1 also comprises a number of legs 11, which are generally known in the art.

The sleeping surface 2 is generally formed from a fabric. The sleeping surface is coupled to the top rail 6, pair of side rails 7, 8 and foot rail 9 using a plurality of springs 12. While not shown, a single mattress generally resides on the sleeping surface 2. Overall, the support generally sags or hammocks, forming a concave surface when viewed from the top. Over time, the sleeping surface 2 and springs 10 fatigue, which exasperates the hammock effect. The sag or hammocking in generally makes the mattress less comfortable and tends to cause sleepers to move inward to the centerline of the mattress. Additionally, any traverse support members used to reduce the hammocking become more pronounced and uncomfortable.

Thus, against this background, it would be desirable to provide a bed frame for a convertible sofa that provided increased comfort and resisted hammocking.

SUMMARY

This Summary is provided to introduce a selection of concepts in a simplified form that are further described below in the Detailed Description. This Summary, and the foregoing Background, is not intended to identify key aspects or essential aspects of the claimed subject matter. Moreover, this Summary is not intended for use as an aid in determining the scope of the claimed subject matter.

In some aspects of the technology, a bed frame having a solid deck for a convertible sofa is provided. The bed frame comprises a pair of side rails and a bottom rail. The bed frame comprises at least a torso frame and a foot frame where the foot frame folds and unfolds with the torso frame to place the convertible sofa in the sofa configuration (folds) or the sleeping configuration (unfolds). The bed frame has at least one solid deck coupled to the torso frame of the bed frame.

These and other aspects of the present system and method will be apparent after consideration of the Detailed Description and Figures herein.

DRAWINGS

Non-limiting and non-exhaustive embodiments of the present invention, including the preferred embodiment, are described with reference to the following figures, wherein like reference numerals refer to like parts throughout the various views unless otherwise specified.

DETAILED DESCRIPTION

The technology of the present application will now be described more fully below with reference to the accompanying figures, which form a part hereof and show, by way of illustration, specific exemplary embodiments. These embodiments are disclosed in sufficient detail to enable those skilled in the art to practice the technology of the present application. However, embodiments may be implemented in many different forms and should not be construed as being limited to the embodiments set forth herein. The following detailed description is, therefore, not to be taken in a limiting sense.

The technology of the present application is described with specific reference to a convertible sofa also known as a sleeper sofa. However, the technology described herein may be used for other foldable furniture and the like. For example, the technology of the present application may be applicable to recliners, vehicle seats, camper furniture, or the like. Moreover, the technology of the present application will be described with relation to exemplary embodiments. The word "exemplary" is used herein to mean "serving as an example, instance, or illustration." Any embodiment described herein as "exemplary" is not necessarily to be construed as preferred or advantageous over other embodiments. Additionally, unless specifically identified otherwise, all embodiments described herein should be considered exemplary.

Figure 1:
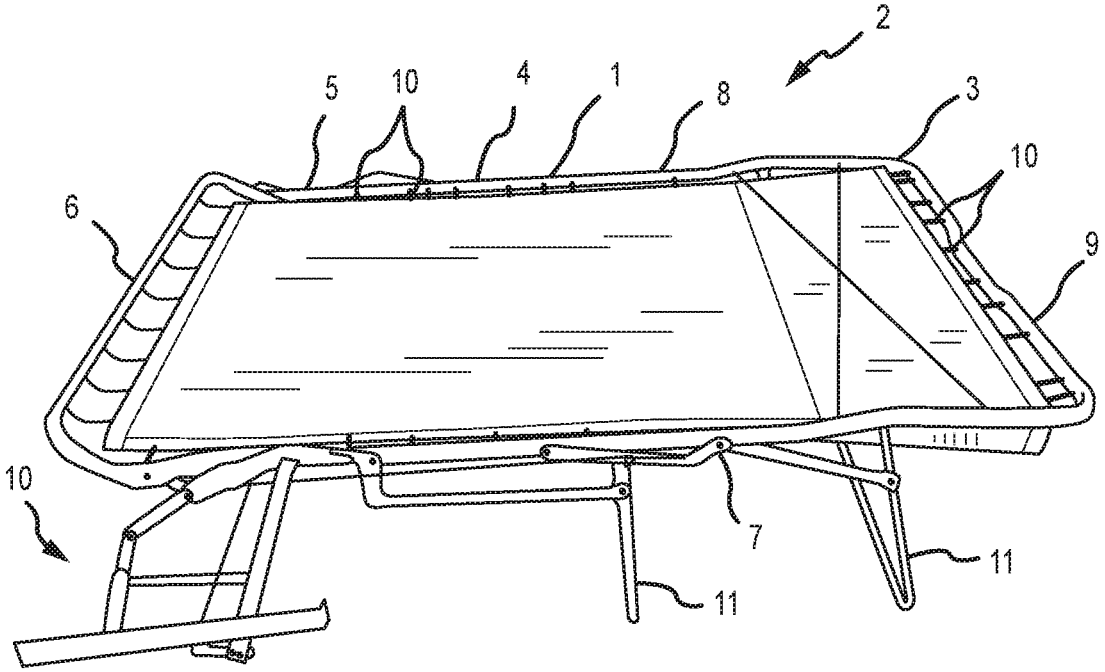
(PRIOR ART) FIG.1
FIG. 1 is a perspective view of a conventional convertible sofa bed frame and sleeping surface.
Figure 2:
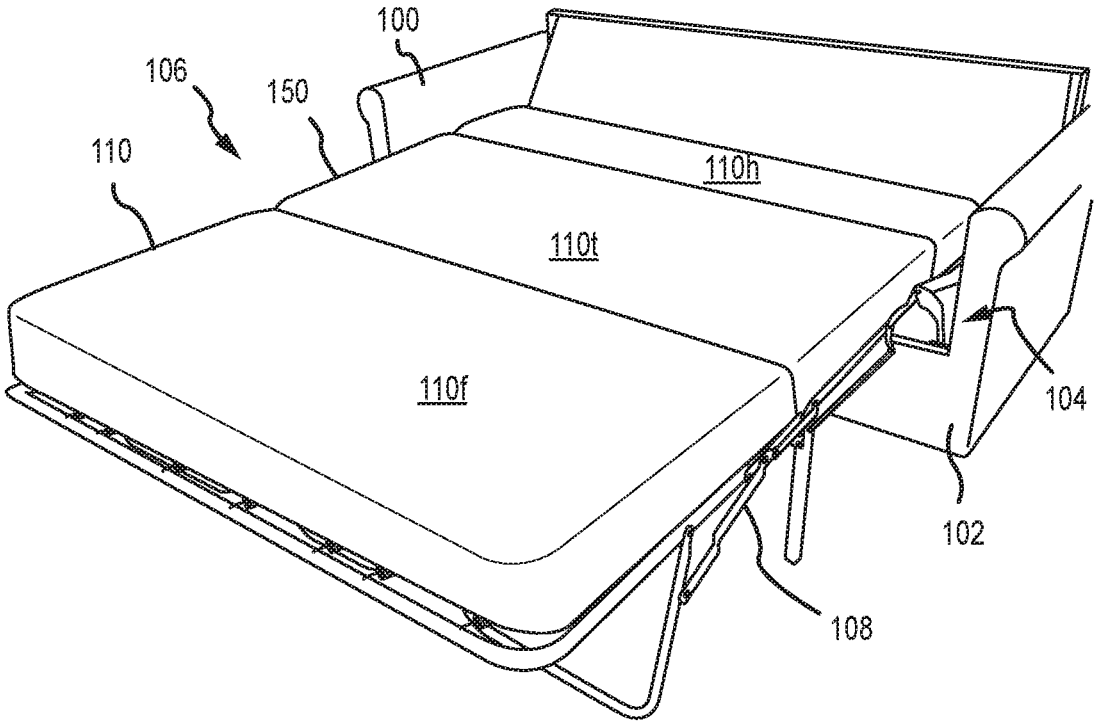
FIG. 2 is a perspective view of a convertible sofa bed in a sleeping configuration consistent with the technology of the present application.

With reference now to FIG. 2, a sleeper sofa 100 is provided. The sleeper sofa 100 includes a sofa unit 102 with a chamber 104 to receive the sleeper portion 106. The sleeper portion 106 includes a bed frame 108 and a mattress 110, which mattress 110 is three mattresses (110*h*, 110*t*, 110*f*) in this exemplary embodiment as will be explained further below. The sleeper sofa 100 is shown in the sleeper configuration. In the sofa configuration, the bed frame 108 and mattress 110 are folded and moved into the chamber 104.

Figure 12:
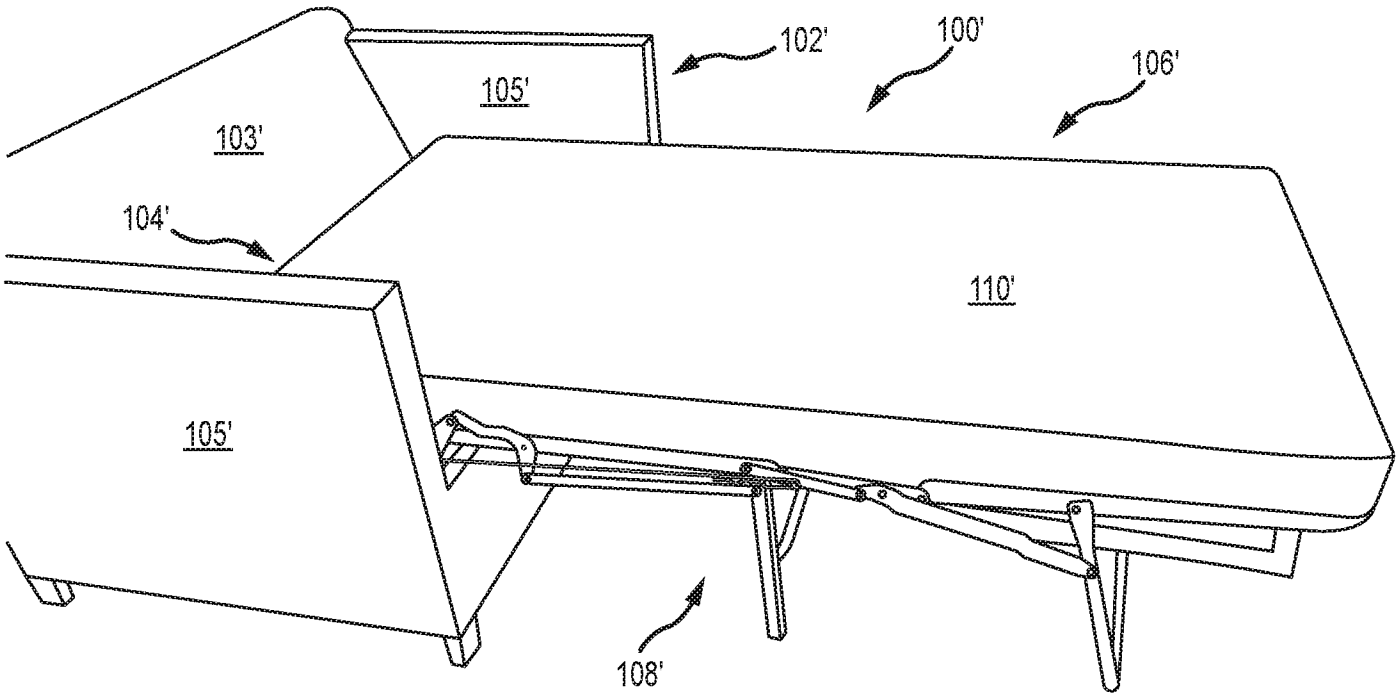

With reference to FIG. 12, a similar sleeper sofa 100′ is provided. The convertible sleep sofa 100′ includes a sofa portion or unit 102′ and a sleeper portion or unit 106′. The sofa portion 102′ includes a back rest 103′, a chamber 104′, and a pair of arms 105′. The chamber 104′ is sized to receive the sleeper portion 106′ when folded into the sofa or stowed position. When stowed, the sleeper portion 106′ forms a horizontal seating surface (not specifically shown). The sleeper portion 106′ includes a foldable bed frame 108′ shown in the unfolded and deployed or sleeper position. The foldable bed frame 108′ supports a mattress 110′ in this exemplary embodiment.

As explained above, the mattress 110 may be a single mattress. In this configuration shown in FIG. 2, however, the mattress 110 is three mattresses, which include mattress 110*h* (for the head portion), mattress 110*t* (for the torso portion), and mattress 110*f* (for the leg and foot portion). Because the body anatomy, weight and distribution on each mattress is different, the mattresses may be configured differently or customized for particular users. The separate mattresses 110*h*, 110*t*, and 110*f* may be connectable via a webbing of material, such as, a part of an envelope 150 or the like, or completely separate. Providing a webbing of material may eliminate gaps between the different mattresses. The mattress 110 may be a single mattress, three (3) mattresses as shown, or other configurations such as two (2) mattresses, five (5) mattresses, etc.

Figure 3:
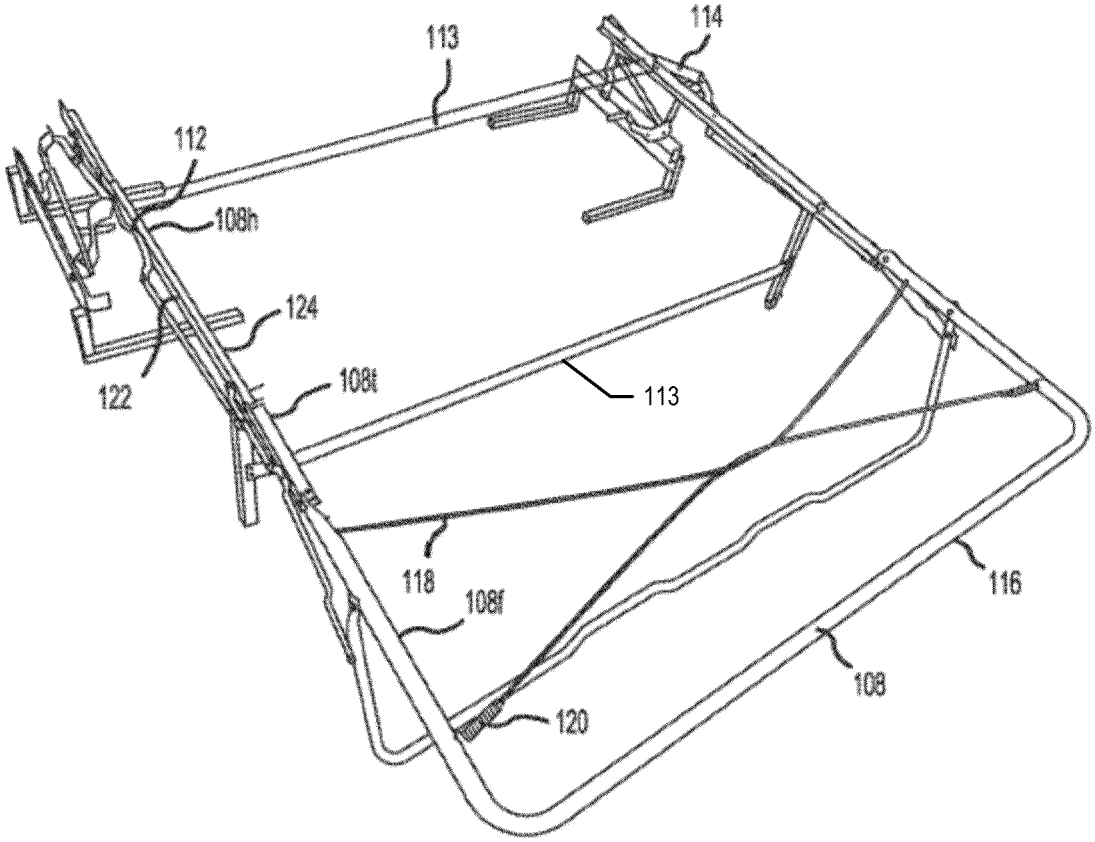
FIG. 3 is a perspective view of a bed frame for the convertible sofa bed of FIG. 2 consistent with the technology of the present application.

FIG. 3 shows the bed frame 108. For convenience, the bed frame 108 is shown as a standalone unit without the sofa unit or mattress. The bed frame 108 has a left rail 112 and right rail 114. The left rail 112 and the right rail 114 are coupled by a bottom rail 116. A head or top rail may be provided, but is not shown in the present exemplary embodiment. The bed frame 108 may have traverse member 113 in certain embodiment. The bed frame 108 may be considered in distinct portions head frame 108*h*, torso frame 108*t*, and foot frame 108*f* that correspond to the three mattresses 110*h*, 110*t*, and 110*f* described above. The foot frame 108*f* may have on e or more support wires 118 coupled to the left rail 112 and right rail 114, either directly or using a plurality of springs 120 as shown. The support wires 118 may be twisted together proximal the center of the foot frame 108*f*.

As can be appreciated, the left and right rails 112, 114 along bed frame 108 at the head frame 108*h* and torso frame 108*t* sections are formed to include a vertical outer wall 122 and a support horizontal wall 124, which form opposed L shapes, although other shapes are possible. The left and right rails 112, 114 have a section along the bed frame 108 at the bottom frame 108*f* that transitions to a tubular shape, which is shown as a O shape, but any polygon shape is possible. The bottom rail 116 is tubular and couples to the left and right rails 112, 114 in a conventional manner, such as the male/female connection shown.

Figure 4:
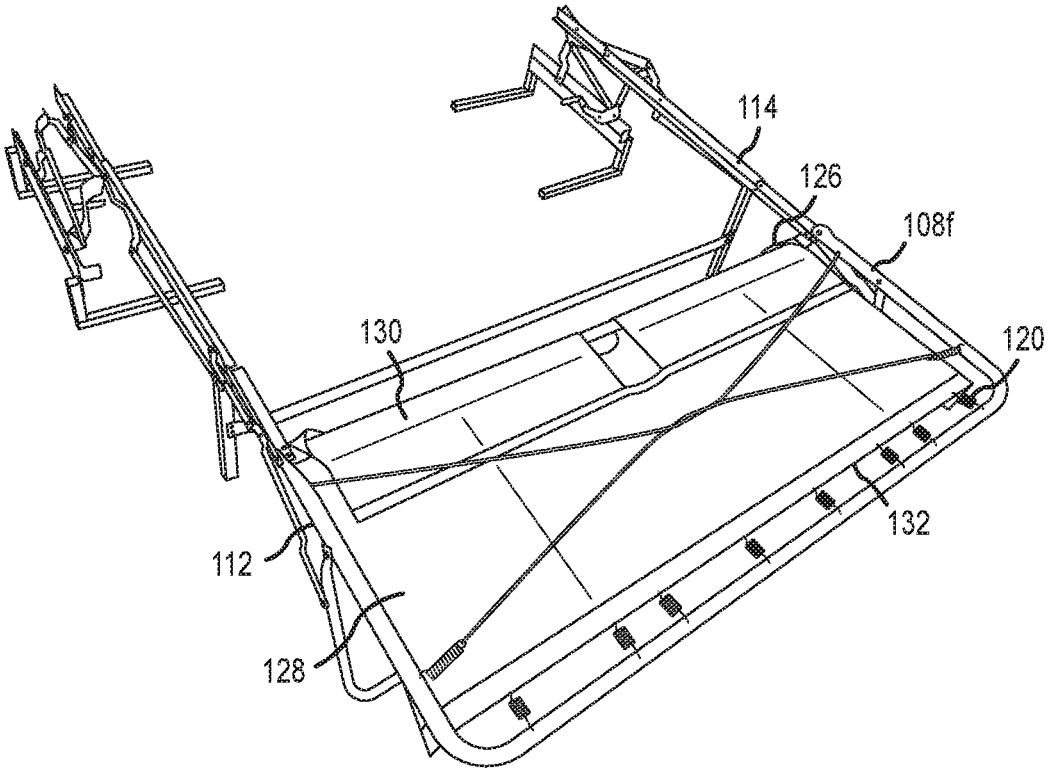
FIG. 4 is a perspective view of the bed frame of FIG. 3 consistent with the technology of the present application.

With reference to FIG. 4, the foot frame 108*f* is provided with a cross member 126 extending from left rail 112 to the right rail 114. A fabric support 128 is coupled to the cross member 126, such as, for example, forming a sleeve 130 in the fabric support through which cross member 126 is extended. The base edge 132 of the fabric support 128 is coupled to the bottom rail 116 using a plurality of springs 120.

Figure 5:
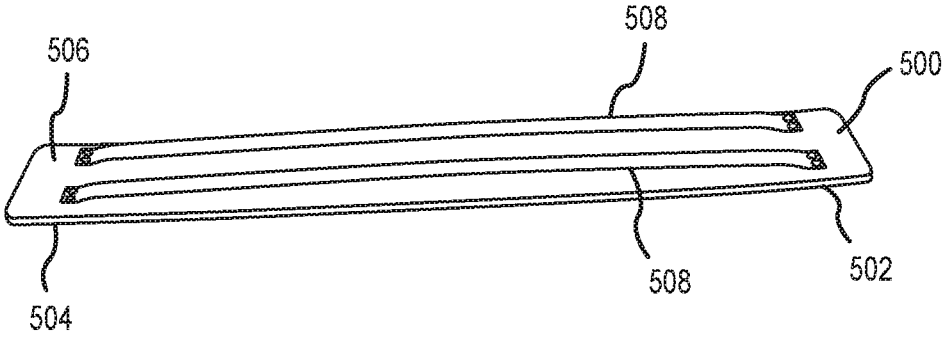
FIG. 5 is a perspective view of the underside of a solid support deck consistent with the technology of the present application.

FIG. 5 shows a first solid support deck 500. The support deck 500 comprises a top panel 502, which may be comprised of wood, metal or a composite material. The top panel 502 has a mattress facing side 504 and an underside 506. One or more support rails 508 are coupled to the underside 506 of the top panel 502. As shown, the top panel 502 is bowed such that the mattress facing side 504, when viewed from above, is a convex surface, the purposes of which will be explained below. The top panel 502 may be flat in certain embodiments.

Figure 6:
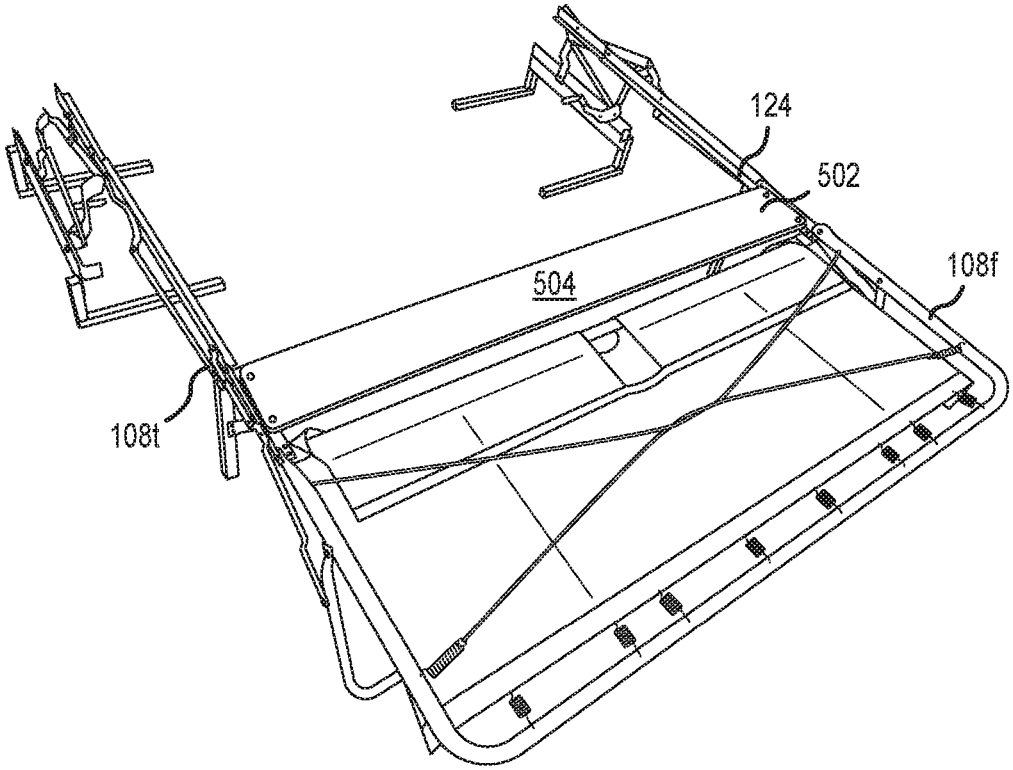
FIG. 6 is a perspective view of the bed frame of FIG. 3 consistent with the technology of the present application.

FIG. 6 shows the first solid support deck 500 coupled to the bed frame 108. The first solid support deck 500 is bolted, or otherwise connected, to the horizontal support wall 124 at the first solid support deck's outer edges 512. The first solid support deck 500 is coupled to the torso frame 108*t* of the bed frame 108 proximal the foot frame 108*f*.

Figure 7:
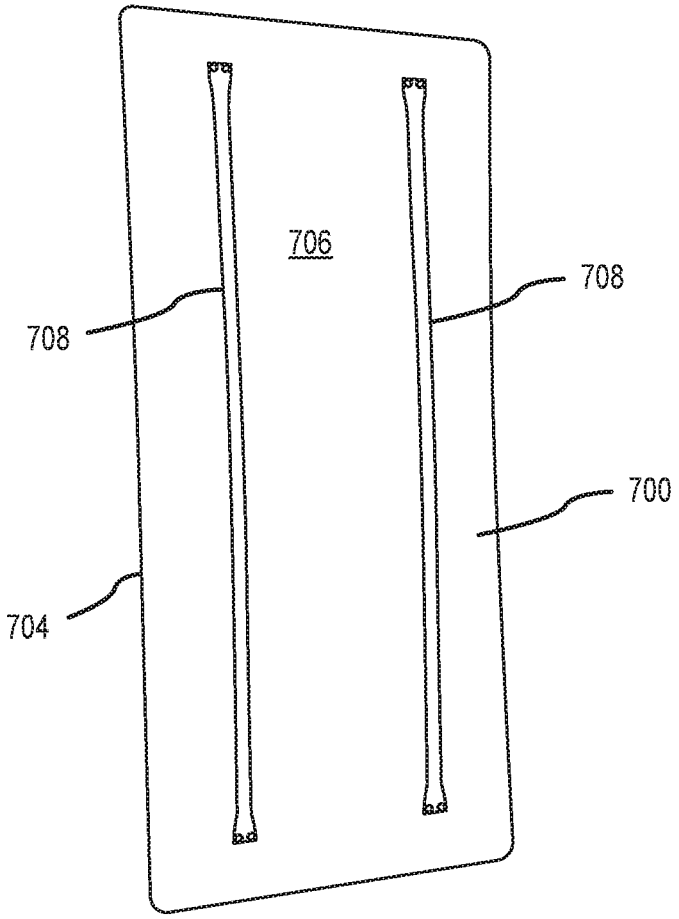
FIG. 7 is a perspective view of the underside of a solid support deck consistent with the technology of the present application.

FIG. 7 shows a second solid support deck 700. The support deck 700 is similar in construction to the first solid support deck 500, including the convex surface when viewed from above. The second solid support deck 700 comprises a top panel 702, which may be comprised of wood, metal or a composite material. The top panel 702 has a mattress facing side 704 and an underside 706. One or more support rails 708 are coupled to the underside 706 of the top panel 702. As shown, the top panel 702 is bowed such that the mattress facing side 704, when viewed from above, is a convex surface, the purposes of which will be explained below. The top panel 702 may be flat in certain embodiments.

Figure 8:
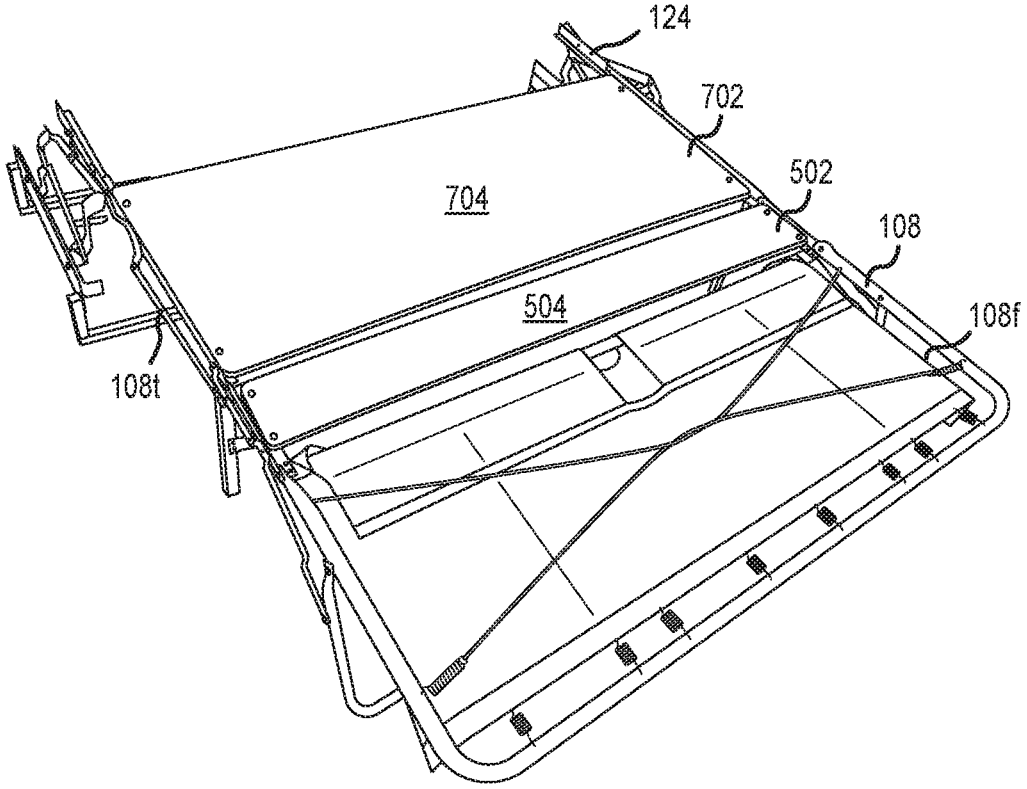
FIG. 8 is a perspective view of the bed frame of FIG. 3 consistent with the technology of the present application.

FIG. 8 shows the second solid support deck 700 coupled to the bed frame 108 along with the first solid support deck 500. The second solid support deck 700 is bolted, or otherwise connected, to the horizontal support wall 124 at the second solid support deck's outer edges 712. The second solid support deck 700 is coupled to the torso frame 108*t* of the bed frame 108 proximal the head frame 108*h*. The second solid support deck 700 generally extends along the remainder of the torso frame 108*t* not covered by the first solid support deck 500. As shown, the second solid support deck 700 is larger than the first solid support deck 500 although other configurations are possible including the decks 500 and 700 being equal in size as well as the deck 500 being larger than the deck 700.

The torso frame 108*t* is provided fitted with the first solid support deck 500 and the second solid support deck 700 in this exemplary embodiment. Other embodiments of the torso frame 108*t* may be provided with a single solid deck. As can be appreciated in this exemplary embodiment, the torso frame 108*t* has a first solid support deck 500 separated from the second solid support deck 700 at a hinge, bend, or pivot axis of the bed frame 108.

Figure 9:
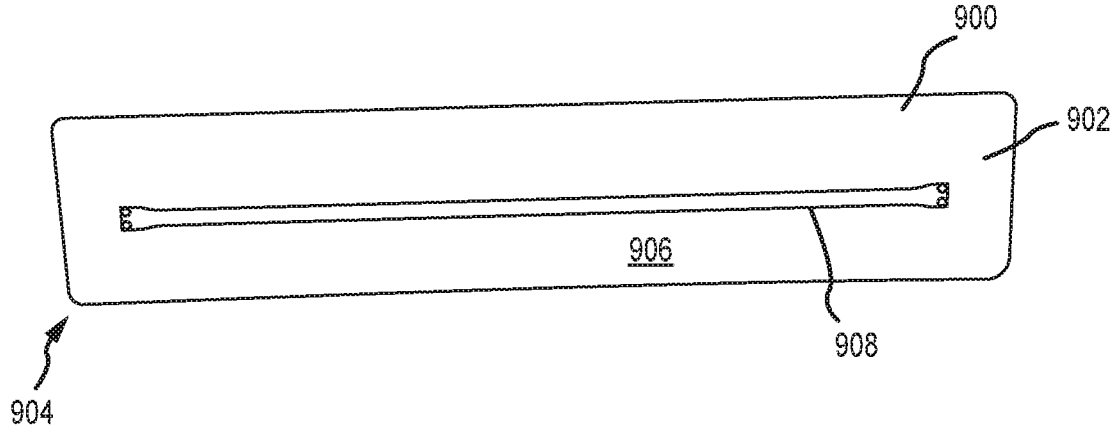
FIG. 9 is a perspective view of the underside of a solid support deck consistent with the technology of the present application.

FIG. 9 shows a third solid support deck 900. The support deck 900 is similar in construction to the first and second solid support decks 500, 700, including the convex surface when viewed from above. The third solid support deck 900 comprises a top panel 902, which may be comprised of wood, metal or a composite material. The top panel 902 has a mattress facing side 904 and an underside 906. One support rail 908 is coupled to the underside 906 of the top panel 902. Additional support rails are possible, but the third solid support deck 900 requires less support than the other decks due to the anatomy and position. As shown, the top panel 902 is bowed such that the mattress facing side 904, when viewed from above, is a convex surface, the purposes of which will be explained below. The top panel 902 may be flat in certain embodiments.

Figure 10:
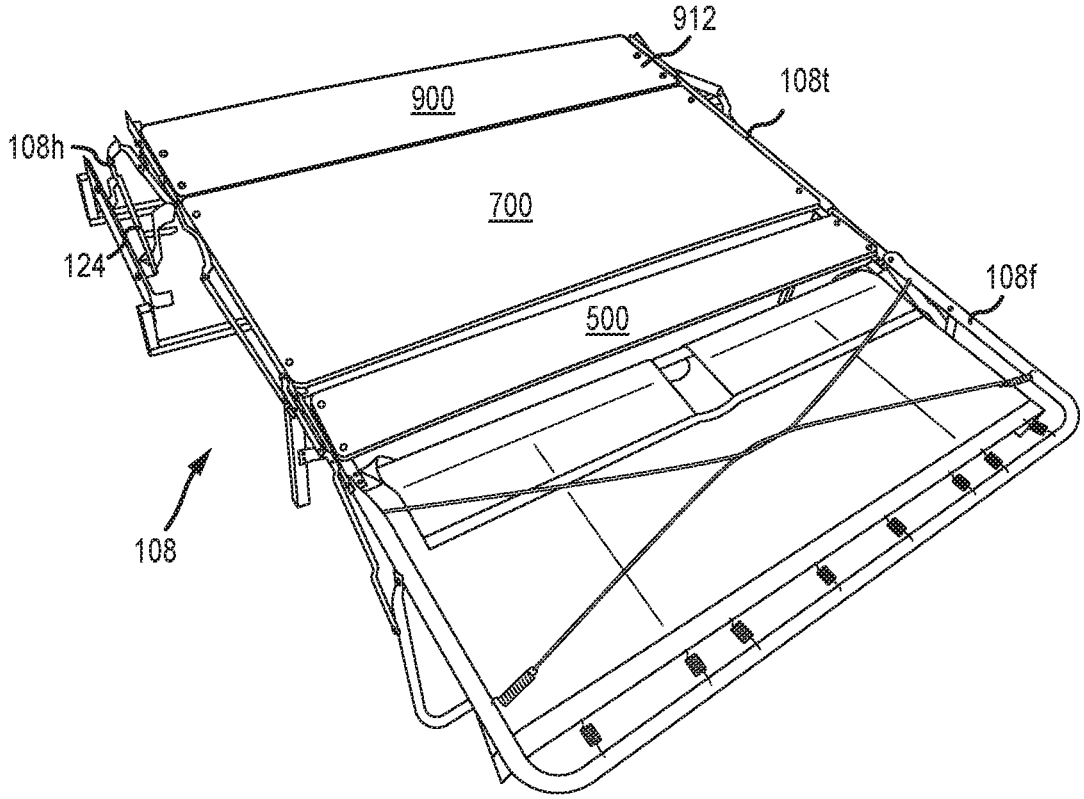
FIG. 10 is a perspective view of the bed frame of FIG. 3 consistent with the technology of the present application.

FIG. 10 shows the third solid support deck 900 coupled to the bed frame 108 along with the first and second solid support decks 500, 700. The third solid support deck 900 is bolted, or otherwise connected, to the horizontal support wall 124 at the third solid support deck's outer edges 912. The third solid support deck 900 is coupled to the head frame 108*h* of the bed frame 108 proximal the head frame torso frame 108*t*. The third solid support deck 900 generally covers the entire head frame 108*h*. Because the support deck is solid, the bed frame 108 does not necessarily have a top rail, which is shown absent in FIG. 3.

As can be appreciated, the foot frame 108*f* may be provided with one or more solid support decks similar in construction to one or more of the first, second, or third solid support decks 500, 700, and 900. However, in the exemplary embodiment shown, the foot frame 108*f* does not have a solid support deck in part because the foot frame 108*f* supports cushions for seating when the sofa is in the sofa configuration (not specifically shown). However, at least a fourth solid support deck could be used in certain embodiments.

Figure 11:
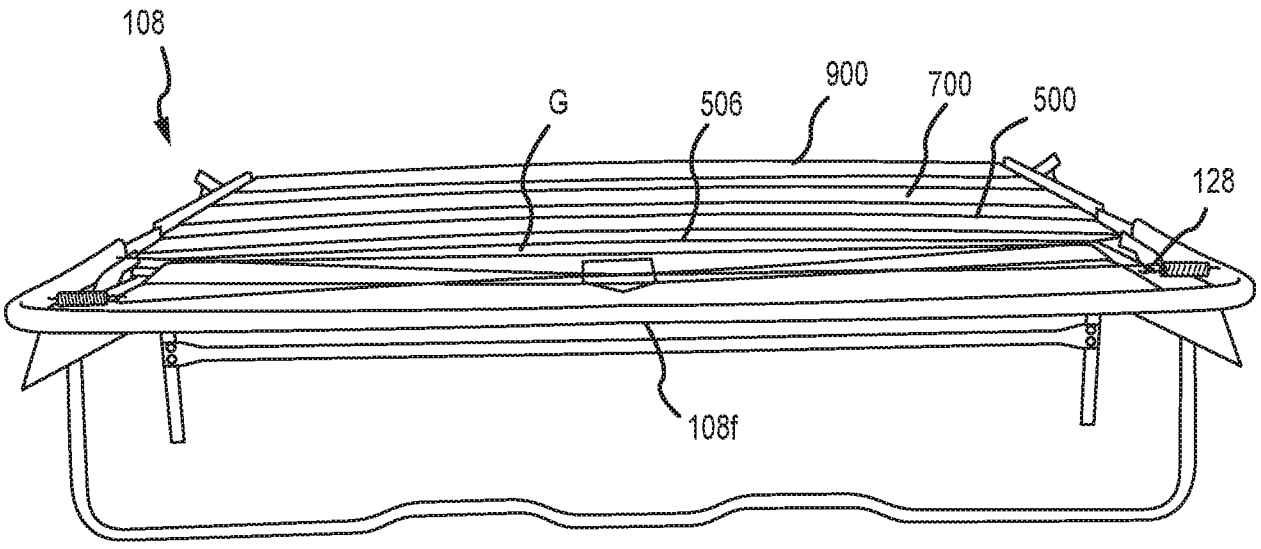
FIG. 11 is a view of the bed frame from the bottom of the bed frame consistent with the technology of the present application FIG. 12 a perspective view of a convertible sofa bed in a sleeping configuration consistent with the technology of the present application.

FIG. 11 shows a view of the bed frame 108 and first, second, and third support decks 500, 700, and 900. The view is from the bottom or foot frame 108*f* towards the top or head frame 108*h*. The convex shape of the first, second, and third solid support decks 500, 700, and 900 can be seen in the view. With specific reference to the first solid support deck 500, a gap G can be seen between, for example, a plane defined by the fabric support 128 and the underside 506 of the first solid support deck 500. The convex shape inhibits the hammocking or sagging effect, which becomes more pronounced over time. When the mattress 110 (or mattresses 110*h*, 110*t*, 110*f*) are placed on the bed frame 108, the weight of the mattress 110 will flatten the first, second, and third solid support decks 500, 700, 900. Generally, the flattening will be until the underside 506, 706, 906 contacts the support rails 508, 708, 908. Because the support decks are flattened, the bowing or convex shape does not need to be exactly the same for each deck. Thus, in certain embodiments, one or more of the decks may be flat rather than bowed.

The above exemplary embodiments provide for a mattress 110 (or mattresses) as separate from the solid support decks 500, 700, 900. In certain embodiments, the solid support decks 500, 700, 900 can be incorporated into the envelope 150 (see FIG. 2) of the mattress 110 (or mattresses 110). As can be appreciated, the technology has been described with three (3) solid support desks. In certain embodiments, two (2) solid support decks may be provided. In other embodiments, four (4) or more solid support decks may be provided depending on the configuration for the furniture.

Although the technology has been described in language that is specific to certain structures and materials, it is to be understood that the invention defined in the appended claims is not necessarily limited to the specific structures and materials described. Rather, the specific aspects are described as forms of implementing the claimed invention. Because many embodiments of the invention can be practiced without departing from the spirit and scope of the invention, the invention resides in the claims hereinafter appended. Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

The invention claimed is:

1. A sleeper sofa mattress frame comprising:

a foldable mattress frame comprising a left rail, a right rail, a bottom rail, a head frame portion, a torso frame portion, and a foot frame portion;

a first solid support deck located at the torso frame portion and coupled to the left rail and the right rail, the first solid support deck comprising a first solid support deck mattress facing side and a first solid support deck underside; and a first support rail coupled to the first solid support deck underside at first support rail ends, the first support rail comprising the first support rail ends and a first support rail middle segment disposed between the first support rail ends, wherein the first support rail is affixed to hold the first solid support deck in a bowed position against a bias force of the first solid support deck, wherein, in the bowed position, a gap is formed between the first support rail middle segment and the first solid support deck underside;

wherein, under a weight of a mattress, the first solid support deck is configured to move into a flattened position such that a portion of the first support rail middle segment closes the gap and contacts the first solid support deck underside;

wherein the first solid support deck is bowed to inhibit hammocking or sagging of the mattress.

2. The sleeper sofa mattress frame of claim 1 comprising:

a second solid support deck located at the torso frame portion and coupled to the left rail and the right rail proximal the first solid support deck, the second solid support deck comprising a second solid support deck mattress facing side and a second solid support deck underside; and a second support rail coupled to the second solid support deck underside at second support rail ends to urge the second solid support deck into a bowed position for the second solid support deck, the second support rail comprising the second support rail ends and a second support rail middle segment disposed between the second support rail ends, wherein a portion of the second support rail middle segment is configured to contact the second solid support deck underside under the weight of the mattress.

3. The sleeper sofa mattress frame of claim 2 comprising:

a third solid support deck located at the head frame portion and coupled to the left rail and the right rail proximal the second solid support deck, the third solid support deck comprising a third solid support deck mattress facing side and a third solid support deck underside; and a third support rail coupled to the third solid support deck underside at third support rail ends to urge the third solid support deck into a bowed position for the third solid support deck, the third support rail comprising the third support rail ends and a third support rail middle segment disposed between the third support rail ends, wherein a portion of the third support rail middle segment is configured to contact the third solid support deck underside under the weight of the mattress.

4. The sleeper sofa mattress frame of claim 3, wherein the mattress is coupled to the first solid support deck, the second solid support deck, and the third solid support deck.

5. The sleeper sofa mattress frame of claim 3, wherein the mattress comprises:

a head frame mattress coupled to the third solid support deck; and a torso frame mattress coupled to the first solid support deck and the second solid support deck.

6. The sleeper sofa mattress frame of claim 5 further comprising a foot frame mattress on the foot frame portion of the foldable mattress frame.

7. A convertible sofa comprising:

a sofa portion, the sofa portion comprising a chamber;

a sleeper portion having a stowed position in the chamber of the sofa portion and a deployed position where the sleeper portion defines a sleeping surface;

the sleeper portion comprising:

a foldable mattress frame comprising:

a left rail, a portion of the left rail comprising a left rail horizontal support wall, a right rail, a portion of the right rail comprising a right rail horizontal support wall, a bottom rail, a head frame portion, a torso frame portion, and a foot frame portion;

a torso frame solid support deck comprising:

a torso frame solid support deck top panel, the torso frame solid support deck top panel having a convex shape, the torso frame solid support deck top panel having a torso frame solid support deck mattress facing side and a torso frame solid support deck underside, a first torso frame solid support deck outer edge coupled to the left rail horizontal support wall at the torso frame portion, a second torso frame solid support deck outer edge coupled to the right rail horizontal support wall at the torso frame portion, and a first support rail coupled to an underside of the torso frame solid support deck top panel interior of the first torso frame solid support deck outer edge and the second torso frame solid support deck outer edge;a head frame solid support deck comprising:

a head frame solid support deck top panel, the head frame solid support deck top panel having a convex shape, the head frame solid support deck top panel comprising a head frame solid support deck mattress facing side and a head frame solid support deck underside, a first head frame solid support deck outer edge coupled to the left rail horizontal support wall at the head frame portion, a second head frame solid support deck outer edge coupled to the right rail horizontal support wall at the head frame portion, and a second support rail coupled to an underside of the head frame solid support deck top panel interior of the first head frame solid support deck outer edge and second head frame solid support deck outer edge; and a mattress forming the sleeping surface;

wherein the first support rail is affixed to hold the torso frame solid support deck in a bowed position for the torso frame solid support deck against a bias force of the torso frame solid support deck, wherein, in the bowed position for the torso frame solid support deck, a first gap is formed between a middle segment of first support rail and the torso frame solid support deck underside due to the convex shape of the torso frame solid support deck top panel;

wherein the second support rail is affixed to hold the head frame solid support deck in a bowed position for the head frame solid support deck against a bias force of the head frame solid support deck, wherein, in the bowed position for the head frame solid support deck, a second gap is formed between a middle segment of the second support rail and the head frame solid support deck underside due to the convex shape of the head frame solid support deck top panel;

wherein, under a weight of the mattress, the torso frame solid support deck and the head frame solid support deck are configured to move into respective flattened positions such that the torso frame solid support deck top panel and the head frame solid support deck top panel contact the first support rail and the second support rail respectively and close the first gap and the second gap;

wherein the convex shapes of the torso frame solid support deck and the head frame solid support deck inhibits hammocking or sagging of the mattress.

8. The sleeper sofa of claim 7 wherein the foldable mattress frame comprises a foot frame portion and the mattress is supported by the foot frame portion.

9. The sleeper sofa of claim 7 wherein the torso frame solid support deck comprises a first solid support deck and a second solid support deck.

10. The sleeper sofa of claim 9 wherein the second solid support deck has a greater surface area than the first solid support deck.

11. The sleeper sofa of claim 8 wherein the foot frame portion comprises a cross member and a fabric support, wherein the fabric support is coupled to the cross member and the bottom rail.

12. The sleeper sofa of claim 11 wherein the mattress comprises a head mattress, a torso mattress, and a foot mattress.

13. The sleeper sofa of claim 11 comprising a plurality of support wires coupled to the foot frame portion wherein the plurality of support wires support the fabric support.

14. The sleeper sofa of claim 11 wherein the fabric support is coupled to the base rail using a plurality of springs.

* * * * *